US010905905B1

(12) United States Patent
Dettore

(10) Patent No.: US 10,905,905 B1
(45) Date of Patent: Feb. 2, 2021

(54) MASK FOR DRINKING A BEVERAGE

(71) Applicant: Robert M. Dettore, Berwyn, PA (US)

(72) Inventor: Robert M. Dettore, Berwyn, PA (US)

( * ) Notice: Subject to any disclaimer, the term of this patent is extended or adjusted under 35 U.S.C. 154(b) by 0 days.

(21) Appl. No.: 16/865,219

(22) Filed: May 1, 2020

(51) Int. Cl.
*A62B 18/08* (2006.01)
*A62B 18/02* (2006.01)
*A41D 13/11* (2006.01)

(52) U.S. Cl.
CPC ..... *A62B 18/086* (2013.01); *A62B 18/025* (2013.01); *A41D 13/11* (2013.01)

(58) Field of Classification Search
CPC ..... A62B 18/086; A62B 18/025; A62B 18/02; A62B 18/10; A61M 16/06; A61M 16/208; A41D 13/11; A41D 13/1176
See application file for complete search history.

(56) References Cited

U.S. PATENT DOCUMENTS 4,841,963 A * 6/1989 Vandeputte ..... A62B 18/086 128/202.15
4,890,609 A * 1/1990 Wilson, II ..... A61M 16/06 128/206.28
2009/0050144 A1* 2/2009 Pierce ..... A61F 5/56 128/200.24
2012/0091381 A1* 4/2012 Kern ..... F16K 15/145 251/336
2012/0247474 A1* 10/2012 Torbenson ..... A62B 18/086 128/206.15
2012/0289851 A1* 11/2012 Varga ..... A61B 5/0836 600/532
2016/0256615 A1* 9/2016 Poormand ..... A61M 1/0003
2018/0195654 A1* 7/2018 Jaeger ..... F16L 37/004

* cited by examiner

*Primary Examiner* — Margaret M Luarca
(74) *Attorney, Agent, or Firm* — Bonini IP Law, LLC; Frank J. Bonini, Jr.

(57) ABSTRACT

A protective mask having a valve assembly that allow a user to drink a beverage while wearing the mask to maintain a safe environment by filtering contaminants, such as pathogens and particles from passing through the mask. The valve assembly may be provided on the mask or may be separately provided for attachment to a mask. The protective mask with the valve assembly has an attachment portion that allows common beverage straws to connect with the valve assembly to allow liquids to be draw through the mask by a user through a passageway. A check valve limits liquid flow in a single direction and actuates to open the valve when a user draws in liquid through the mouthpiece. The valve remains closed and blocks passage of inhaled or exhaled air, and blocks liquid flow in the direction opposite of the flow direction.

33 Claims, 4 Drawing Sheets

MASK FOR DRINKING A BEVERAGE

BACKGROUND OF THE INVENTION

1. Field of the Invention

The present invention relates to the field of protective devices for respiratory functions, and more particularly articles that provide covering of a user's mouth and nose and permit the user to consume a beverage while wearing the protective article.

2. Brief Description of the Related Art

Protective respiratory masks are known as face masks or respirators. One type of face mask is a surgical mask, which typically is a loose-fitting article that creates a physical barrier between the mouth and nose of the wearer and the environment. The surgical masks often are used to prevent the user from inhalation exposures to potential contaminants in the immediate environment. These masks are disposable and are discarded after use. Not all face masks qualify as surgical masks, as there are some regulations that may denote what properties a mask may need to possess in order to be deemed or used as a surgical mask. The edges of this surgical type mask are not designed to form a seal around the nose and mouth. Another type of mask is known as a respiratory protective mask or device. The respiratory mask or respirator mask is designed to achieve a very close facial fit and provide efficient filtration of airborne particles. The design of the respiratory type mask has edges that form a seal around the nose and mouth. A type of mask that achieves this function is an N95 respirator or surgical N95 respirator. The N95 surgical type masks are widely used in healthcare facilities and applications. An N95 type surgical mask is generally considered to be a subset of N95 Filtering Facepiece Respirators (FFRs), often referred to as N95s. Both the surgical type masks and the N95 type surgical respirators and FFRs are designed for a single use, and to be disposed of after use. The masks also must undergo tests for fluid resistance, filtration efficiency (such as particulate filtration efficiency and bacterial filtration efficiency), flammability and biocompatibility. In addition, some masks may have exhalation valves that can make breathing out easier and may also reduce heat build-up. However, where sterile conditions are desired in an environment, then masks with exhalation valves, including the N95 surgical respirators are not used in order to maintain the barrier between the user and the environment.

Users in surgical or medical procedural settings typically wear a mask for the duration of the procedure, then discard the mask, and no longer wear the mask for other work. However, in environments where pathogens are present or there is a potential for high infectious levels of pathogens, then medical personnel may wear masks even when a medical procedure is not being carried out. This may include patient consultations or examinations, or visits where a medical or healthcare personnel are interacting with or holding in-person visits with a patient. In addition, because of some conditions, such as increased disease spread due to epidemics, pandemics or other high levels of infectious potentials, medical personnel, as well as even members of the public, may wear protective masks during activities where the person is or is likely to be in proximity with others. For example, some healthcare facilities mandate that physicians and other healthcare staff, and employees at the facility as well as visitors and some patients, wear face masks or coverings. In some cases, the individuals must wear the protective mask at all times when they are present at a facility. However, there are some instances where a user must remove the mask, for example, to eat or drink. In these instances, the user must go to a separate or confined area where the user can be alone, which may be inconvenient, or distantly located.

Unlike a healthcare facility which is a controlled environment, individuals in certain circumstances where an epidemic, pandemic, or other potential infectious condition is present, may wear a protective face mask or covering, and, in some situations, government authorities, such as a federal, state or municipal bodies, may require individuals to wear protective masks in public.

Whether the individual wearing a mask is a healthcare worker or individual, the mask must be removed for certain functions, such as eating and drinking. In situations where an individual is isolated from others, such as a healthcare co-worker in an office, an individual in a car, or a person in a separate space, the individual may remove the mask and there is little or no danger of becoming infected or infecting others, since no others are present or nearby. However, eating and drinking activities may need to be limited in situations where a number of individuals are present, or where individuals are in closer proximity to one another. Eating and drinking at such locations may be prohibited, or not feasible where there is a contagion or risk of an infectious disease. In some instances, requirements for mask wearing have rendered some locations, such as, for example, a bar area of a restaurant to be closed, since individuals are in close proximity, and, even if they are wearing face masks, drinking and eating activities cannot be done without the removal of the mask, or if a user attempts these activities while wearing a mask, the removal of the mask or repositioning of the mask in such a way then compromises the primary purpose of the mask.

A need exists for a way to provide protection to individuals while individuals are together and allow individuals to consume a beverage without the need to remove a protective mask.

SUMMARY OF THE INVENTION

A device for providing protection against particles and pathogens is provided, configured in the form of a protective mask, and more particularly a face mask that provides a user with the capability to wear the mask and consume a beverage without having to remove the mask. The currently available masks prevent beverage consumption in social settings without removal of the mask. The present design provides a mass-produced and disposable mask that permits the wearer of the mask to consume a beverage in a social setting without the need for mask removal or other alternative behaviors that would render the mask ineffective, compromise the capability of the mask to perform its protective function, or require the user to segregate themselves from others (if the user would need to take off the mask).

The product promotes individual and public safety, and allows individuals to socialize. The product also allows an individual to minimize the spread of transmission of disease by wearing a mask covering the nose and mouth, while maintaining the ability to consume a beverage. The mask for drinking a beverage not only protects the user against pathogens but also protects others by preventing transmission of pathogens from the user when the user wears the mask.

According to a preferred embodiment, the mask for drinking a beverage of the present invention is configured similar to masks commonly used and commercially available in the marketplace. The present mask may be constructed from materials from which masks are made, including the surgical type masks and tighter fitting N95 type masks. The present mask for drinking a beverage is provided with a check valve/back flow prevention system, which according to preferred embodiments, mates with a common straw of varying sizes. The mask therefore allows a user to obtain a beverage and mate a common straw to the valve connector of the mask and enjoy the beverage. This may be done without the user removing the mask. The check valve also provides a seal against exhalation by the wearer through the straw. In addition, the check valve is configured to actuate and open when the user withdraws the liquid through a connected straw (to allow the liquid to pass through the check valve of the mask's conduit or straw element), but also remains closed when the user inhales while wearing the mask. The inhalation by the user takes in air through the fabric of the mask so that the air resistance of the fabric or mask material is more permeable than the check valve. In other words, the resistance through the mask fabric is less than the force required to open the check valve. This arrangement provides a seal effect, but allows the user to drink a beverage through the connected valve when the user purses the user's lips around the straw mouthpiece to draw from the beverage.

According to preferred embodiments, the breathing resistance of the mask therefore has a relationship with the check valve so that the breathing resistance allows the mask to retain its shape while the user breathes in (and out), and the valve resistance has a higher level to open the valve so that it remains closed when the user breathes in through the mask. In addition the check valve is configured to remain closed or block passage when the user exhales or provides increased pressure (in the case of a sneeze) so that when the user exhales (or were to sneeze) the mask catches the particles and the valve continues to provide a seal against the particles escaping.

The straw mating assembly may include a suitable connector that makes a connection with a common straw. The connector may be provided with a single connector, or may be provided with a tapered or stepped connector for handling different diameters of common straws. According to some embodiments an adapter may be provided to handle different sizes of common straws to connect a common straw to the straw mating end.

According to some embodiments, the straw attachment or straw mating end of the device has a tapered end that is designed to fit within a typical drinking straw. According to other embodiments, the straw mating end may fit over the end of a common straw. Because drinking straws may be provided in different sizes, i.e., having different diameters, according to some embodiments, the tapered end is configured with an end that is smaller at the tip end, and larger away from the tip. Some embodiments may have a stepped taper, while others may have a conical taper. The straw attachment preferably is made from a material which when engaging a straw will impart a seal against the straw wall. Alternate embodiments may provide a straw attachment that fits over the straw, with the taper being largest at the open or tip end, and smaller away from the tip end.

Embodiments of the mask provide a straw or conduit with a passageway containing a check valve, which allows a user to withdraw a beverage through the straw, but prevents liquid or air from passing out of the straw through the passageway, as a result of the check valve. The mask is made from a suitable material and the straw passes through the mask, preferably, through an aperture in the mask material. A sealant is used to seal the straw against the aperture. According to some embodiments, additional components may be provided to facilitate mounting of the straw, including a valve assembly base that may comprise one or more portions that may integrate the straw or sealingly attach to the mask and/or straw.

The mask minimizes the spread or transmission of disease by allowing a user to wear the mask while consuming a beverage. The mask allows beverage service facilities to maintain the typical serving methods and straws provided. The mask has utility for social events, such as for example, sporting events where beverages are sold, distributed or consumed. The mask may be used for drinking many types of beverages, from water, to milk, carbonated beverages, cocktails, as well as protein and nutritional beverage products.

The mask is designed to be economical to produce, and is disposable.

BRIEF DESCRIPTION OF THE DRAWING FIGURES

DETAILED DESCRIPTION OF THE PREFERRED EMBODIMENTS

Figure 1:
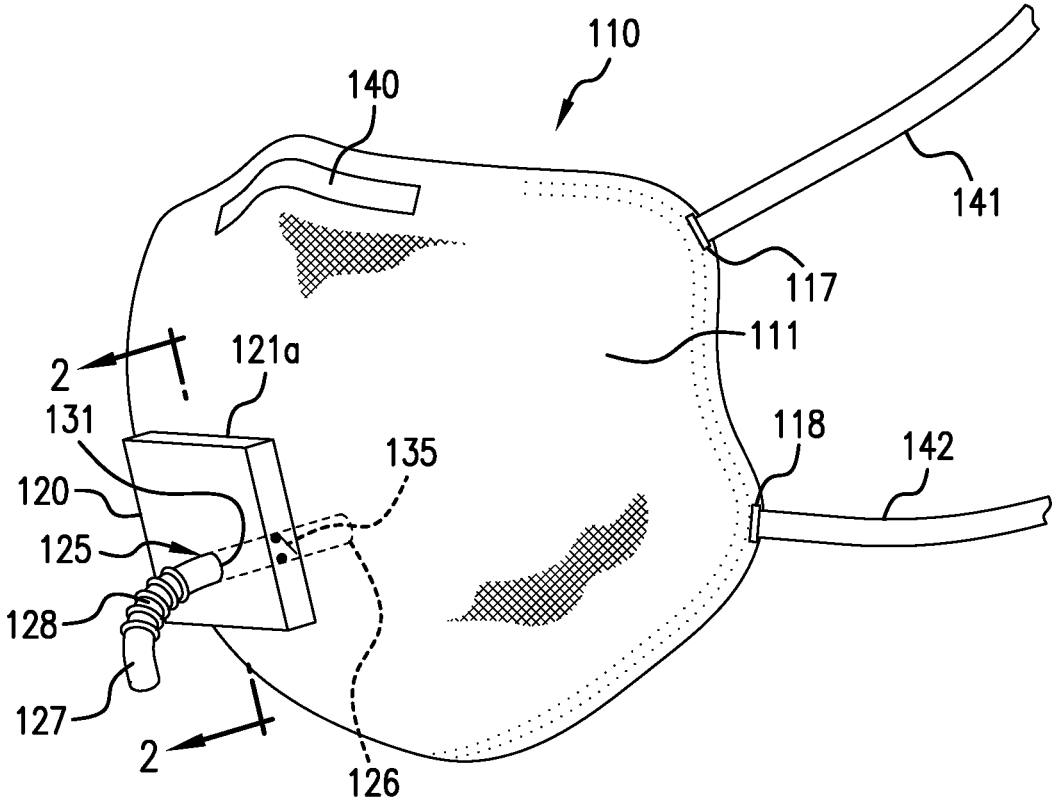
FIG. 1 is a perspective view of an exemplary embodiment of a protective mask article according to my invention as viewed from the front left side, from above the mask looking down.

Referring to FIG. 1, a mask 110 according to an exemplary embodiment of the invention is shown. The mask 110 has a mask base 111 which is made from any suitable protective material which may be a fabric material, nonwoven fabric, or synthetic type of material. For example, some typical masks may be constructed from a fabric-like material made from staple fiber (short) and long fibers (continuous long) that are bonded together by a suitable bonding technique that may involve treatment with chemicals, mechanical manipulation or pressure, heat and/or solvents. Some other materials used for the mask base or base include polypropylene. One type of polypropylene is polypropylene having a density of about 20 or 25 grams per square meter (gsm). Other mask body or mask base materials include natural or synthetic materials or combinations thereof. For example, some materials used to construct the mask body or base may include polystyrene, polycarbonate, polyethylene, or polyester, as well as cotton or other natural fibers, or combinations fibers. The mask body or base may be provided to have particulate filtering properties. Alternatively, filtering layers may be provided on one or both sides of the mask base or layer to achieve filtration of particles. For example, according to some embodiments, the mask base 111 may be constructed comprising two filter layers effective at filtering out particles, which according to some embodiments may have capabilities of filtering bacteria above 1 micron. The filtration layers may be provided on opposites sides of an intermediate layer (and in some embodiments the intermediate layer may comprise a plurality of layers). Alternatively, the mask base 111 may be configured from a materials to provide the desired filtration level for the intended use. The mask base 111 may be constructed to provide the desired filtration level, for example, by selection of the fiber, the way the base is manufactured, the base web structure, as well as the cross-sectional shapes of the fiber used to form the base or a layer thereof. The mask base 111 may be formed using any suitable process for constructing a mask, and may be made from a suitable material to provide the desired level of protection, filtration and support for the valve/straw assembly.

According to some embodiments, the mask base 111 may be constructed to provide filtering out of at least 95% of particles greater that 0.3 microns in size. The mask 110 when configured from materials that provide this 95% level of 0.3 micron filtering may be an N95 type mask. According to some examples, the mask base 111 may be comprised of nonwoven material that has a dense network of the fibers that may be as small or thin as a single micron. The mask filters out particles as particles become trapped as the particles attempt to pass through the fibers.

The mask 110 may be configured to filter out the 0.3 micron particles. For the type of mask with the higher N95 filtration, according to some embodiments, the mask base 111 may be constructed from multiple layers of nonwoven fabric. One or more, and preferably two outward protective layers of fabric, one covering the inside and another covering the outside of the mask are provided. One typical way of producing the layers is using a process called spunbonding, which utilizes nozzles blowing melted threads of a thermoplastic polymer (e.g., such as polypropylene) to layer threads between 15-35 micrometers on a conveyor. This layering then forms a cloth as the conveyor continues downstream, and the fibers are then bonded using thermal, mechanical, or chemical techniques (or combinations of techniques). According to preferred embodiments, where the mask base is of an N95 type, the mask 110 (also referred to as a respirator when having the 0.3 micron filtering properties) may be comprised of material that is between about 20 and 50 g/m2 in density. The mask base also may have one or more layers between the outer or spunbound layers. The filtration layer or layers preferably include a filtration and/or prefiltration layer (or layers) which is situated between the outer layers and typically may comprise a more dense layer, such as about 250 g/m2. These pre-filtration layer or layers have suitable density for the mask to maintain conformity of shape when worn. The mask base 111 may be constructed by attaching the layers together using any suitable attachment method. For example, where the pre-filtration layer is used, it is typically, a needled nonwoven material, which may be needle punched (e.g., using barbed needle punctures of the fabric) in order to increase cohesiveness and hook the fibers together. The fibers may be thermally bonded through an application of heat using a calendaring process (with high heat and pressure rollers), which preferably stiffens the fibers and allows them to be formed to a shape.

The mask 110 whether constructed from surgical type filtration materials or N95 type filtration material, is fitted with the valve assembly or mechanism 120. The valve assembly 120 is shown according to a preferred embodiment comprising a valve base 121. The base 121 may be provided as a single element or a plurality of elements. The base 121 although shown enlarged, may be thin and provided to be near the surface of the mask. The valve base 121 attaches to the mask base 111 and supports the valve assembly straw 125. The straw 125 is shown having a mouthpiece end 126 and an attachment end 127. The straw 125 includes a passageway 125*a* therethrough. The straw 125 preferably may be flexibly configured, as shown for example at the straw attachment end 127 which is formed having corrugations 128 that provide the capability to maneuver the straw 125 relative to the mask 110. A common drinking straw that attaches to the straw attachment end 127 may be moved when connected thereto, and movement may be facilitated by the flexible corrugations 128. The mask 110 may remain fixed on the user's face while the user takes in a beverage through a common beverage straw and the device straw 125. Embodiments of the mask 110 provide a conduit or straw 125 with a passageway 125*a* containing a check valve 135, which allows a user to withdraw a beverage through the straw 125, but prevents liquid or air from passing out of the straw 125 through the passageway 125*a*, as a result of the check valve 135. The mask 110 is made from a suitable material and the straw 125 passes through the mask 110, preferably, through an aperture 111*a* in the mask material 111. A sealant is used to seal the straw 125 against the mask aperture 111*a*. According to some embodiments, an adhesive sealant may be provided to seal the conduit or straw 125 to the opening 111*a* in the mask material 111. The adhesive sealant may be provided as a layer and may comprise a valve assembly portion, such as for example, a layer on one or both sides of the mask material 111*a* around the straw 125 and sealing the aperture 111*a*. According to some embodiments, the valve assembly may comprise a single component (such as a single adhesive layer or single base element sealed to the mask material and straw), and according to some other embodiments may comprise a plurality of components, such as for example, an inner and outer base portion. The straw, such as the straw 125 may be provided in sections or as a single component, and, according to some embodiments, the straw may be integrally provided as part of a valve assembly base element, to mount to the mask material with the base element. According to some other embodiments, a valve assembly base may comprise one or more portions that may integrate the straw or sealingly attach to the mask and/or straw.

Figure 2:
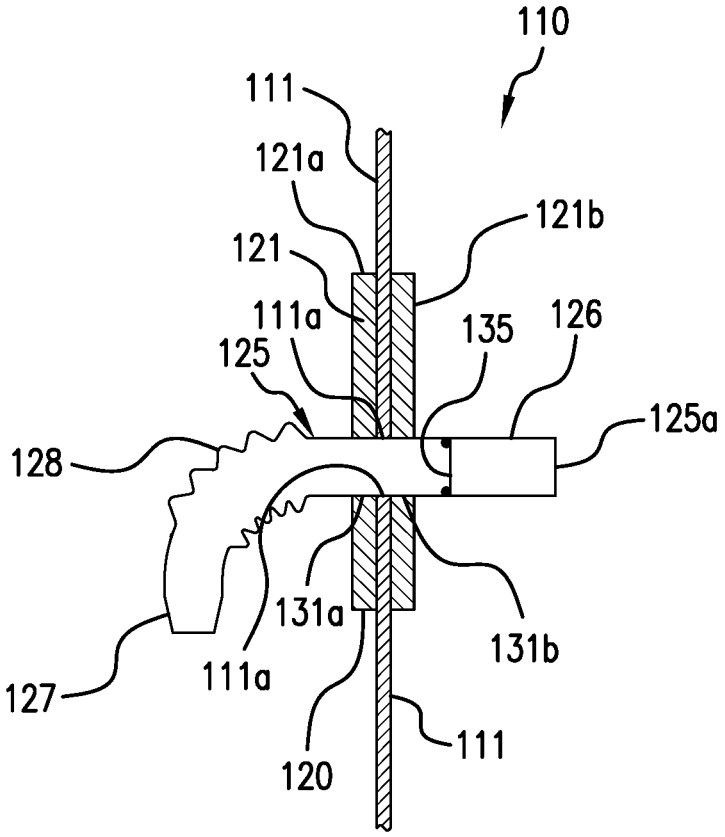
FIG. 2 is an enlarged sectional view taken longitudinally through the valve mechanism of the mask shown in FIG. 1 along the section line 2-2 of FIG. 1.

Referring to FIG. 2, the valve assembly 120 is shown according to a preferred embodiment in an enlarged view separate from the remaining portion of the mask illustrated in FIG. 1. The valve assembly 120 is illustrated comprising a valve frame or base 121. In the exemplary embodiment illustrated, the valve assembly base 121 is shown provided in two sections, including a first section 121*a* on the outside of the mask 110 positioned at the location where the user's mouth is expected to align when the mask 110 is worn, and a second section 121*b* on the inside of the mask 110. The valve assembly base 121 is shown making a seal with the straw 125. According to some embodiments, the valve assembly base 121 may be constructed as a unitary component with the straw 125. For example, the straw 125 when provided integral with the valve assembly base 121 may pass through the mask material or base 111 and a seal may be used to seal the straw 125 around the opening in the mask material through which the straw 125 passes. Although not shown in the figures, a sealing member such as a gasket or washer, an adhesive sealant, or other sealing means may be provided to seal the base 121 and straw 125. The base 121 is shown having an opening therein which allows for the reception therein or passage of the straw 125 therethrough. According to the embodiment illustrated, as shown in FIG. 2, each base member section 121*a*, 121*b* has a respective opening 131*a*, 131*b*. According to embodiments where a sealing member is utilized, the sealing member also may provide a seal entirely through the opening, or may seal partial or entirely, the area between the base sections 121*a*, 121*b*, on a single side thereof or on both sides thereof. According to some embodiments where the valve assembly base 121 is provided in two sections, such as the base sections 121*a*, 121*b*, the straw 125 may be provided as a unitary structure with one of the base sections. According to a preferred embodiment, the straw 125 is provided with a check valve and is connected to the interior base section.

According to a preferred embodiment, the valve assembly base 121 is constructed from a material that provides a seal itself so that the straw 125 is sealed with the base 121 to prevent passage of air or other material from entering or exiting around the sealed area. For example, according to some embodiments, the valve base 121 is constructed with the straw 125, and each straw portion, such as the mouthpiece 126 and the attachment end portion 127 are attached to or formed integral with the base 121. The base 121 may be provided in two sections 121*a*, 121*b*, each section including the respective straw portion 127, 126. The base sections 121*a*, 121*b* may be secured together to form a seal around the straw 125 and the location where the valve mechanism 120, such as the base 121 or the straw 125 passes through the mask base 111. The base may snap fit together, and crimp the mask material of the mask base 111 to provide a seal that is as effective as the mask material or mask base 111 from preventing the passage of germs through the mask 110 (by sealing or filtering them through the mask material).

As depicted in FIG. 2, the valve mechanism 121 includes a check valve 135 shown situated within the passageway 125*a* of the straw 125. The check valve 135 according to a preferred embodiment is illustrated situated in the inner portion or mouthpiece end 126 of the straw 125. The check valve 135 may be the same diameter as the diameter of the mouthpiece end 126, or if needed to accommodate the sealing operation, may be larger than the straw diameter. According to a preferred embodiment, the check valve 135 is situated in the straw and is secured therein to prevent inadvertent removal. Preferably, the check valve 135 is located in the mouthpiece portion 126 of the straw 125.

The mask 110 is used by the user placing the mask 110 over the user's face to cover the mouth and nose. Preferably, the mask is provided with suitable attachment means, which for example, may comprise ties or more preferably, elastic bands that make securing and removing the mask easy and less time consuming. As shown in the exemplary embodiment, the attachment means is shown comprising elastic bands 141, 142. The upper elastic band 141 preferably is continuous and is fastened to the mask base 111 at a fastening point 117 with any suitable fastening mechanism, including, for example, adhesive, a tie, a staple, or other means. The lower fastening band 142 is shown attached to the mask base 111 at the lower fastening point 118. Although not shown, preferably, each band 141, 142 extends to the other side of the mask 110 (not shown) and attaches to similar locations on the opposite mask side. The upper band 141 is designed to fit over the wearer's ears, and the lower band 142 preferably fits under the user's ears. Although elastic bands 141, 142 are shown as the attachment means, other suitable attachment means and arrangements thereof may be used to secure the mask 110 to a wearer, and preferably are provided as part of the mask 110. According to some embodiments, the masks according to the invention may be configured to have supporting structures, such as for example, the nose bridge support 140 which is shown in FIG. 1 comprising a flexible strip of material, such as metal or plastic that may be bent by a wearer to conform the upper portion of the mask to seal over the user's nose bridge.

When the mask 110 is comfortably in place on the user, the user may engage in activities that the user desires, including permitted activities in environments where the user is required to wear the mask (e.g., such as in a store or in locations with others). For example, where the user using the mask desires to visit a bar or other location where there are individuals in attendance, the user may drink a beverage without removing the mask 110. According to other situations, the establishment, such as a bar or restaurant or other facility where socializing may take place, may provide the mask 110 to a consumer or patron. For example, the establishment may distribute masks to patrons in a safe area (parking lot or other area), precluding the need for users to carry a mask, or to ensure that the level of mask protection within the establishment meets a uniform level of protection (or standardization among the guests present). A user may place the straw of a beverage drink into the straw attachment 127 of the mask straw 125. The user may then withdraw the beverage through a straw placed in the beverage drink and through the mask straw 125. The user places the user's mouth on the mouthpiece straw 126 and draws in the liquid beverage. The withdrawing action by the user causes the check valve 135 to open and allow the beverage fluid flow through the mask straw 125 and to the user's mouth. In order to withdraw liquid, the user's pursed lips engage the straw 125, and particularly the mouthpiece end 126 on the interior of the mask 110. The straw 125 which contains the check valve 135 therein prevents the passage of fluid or air from the wearer back out through the mask 110. The check valve 135 or back flow preventer in its normal condition remains closed (sealing off the straw passageway 125*a*) and will open when the user wearing the mask 110 attempts to draw from the user's beverage via a common straw (supplied by the establishment serving the beverage or by the user) that attaches to the valve mechanism 120, which in the preferred embodiment, attaches to the attachment end 127 of the straw 125. The air pressure of normal breathing activities within the properly worn mask 110 assures closure of the valve 135 so that any exhaled air will pass through the mask fabric, such as the mask base 111.

According to an alternate embodiment, a mask valve assembly may be provided for a user to attach to an existing mask. The assembly 120 may be provided with base sections 121*a*, 121*b* that are connectable to each other. The connectable base sections 121*a*, 121*b* preferably are placed on each side of the mask base 111, with one section on the interior and one on the exterior, and are pressed together to connect. For example, according to another embodiment, one or more of the base sections 121*a*, 121*b* or straw 125 may comprise a sharp or pointed end or structure to puncture the mask material 111 to provide an opening for the straw 125 to pass. According to an alternate embodiment, the straw 125 does not require a sharp or pointed end, and an aperture (such as the aperture 111*a*) is provided in the mask material or base 111, and a suitable sealing mechanism seals the straw 125 to the aperture to prevent air and particles from passing between the exterior of the straw 125 and the aperture 111*a* (see FIG. 4). A suitable sealing mechanism seals the opening around the straw exterior, and may include a gasket, adhesive, washer, silicone busing or other element. According to some embodiments, the straw 125 may be provided in sections that connect to provide an air and liquid tight seal when the first and second base portions 121*a*, 121*b* are connected together. For example, the straw 125 may comprise two interfitting sections that secure to each other. The interfitting straw sections may be provided to fit together and not be removable to ensure a secure seal. For example, a barb or other element may be provided to prevent detachment of the straw sections once they are connected.

Figure 3:
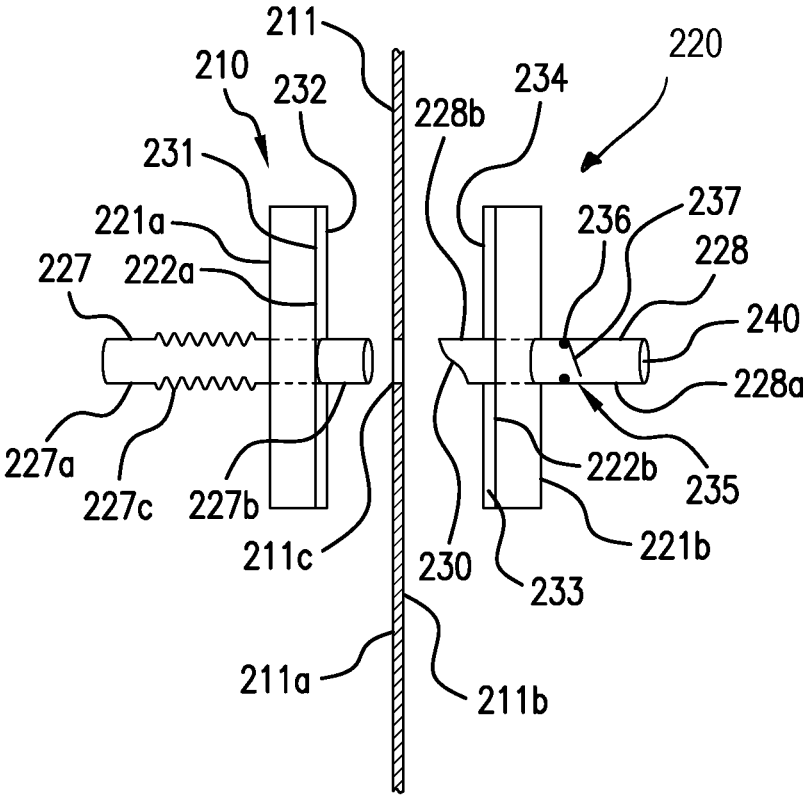
FIG. 3 is a side elevation view of an alternate embodiment of a valve assembly for a mask shown in an exploded view with a mask, the mask base being shown in a sectional view.

Referring to FIG. 3, an alternate embodiment of a protective device 210 is shown comprising a valve assembly 220. The valve assembly is mountable to a mask and, according to preferred embodiments provides a puncture in the mask material to sealingly connect a conduit such as a straw member therethrough so that liquid may be drawn from a beverage or container outside of the mask, and a user wearing the mask may withdraw the liquid beverage through the conduit or straw and into the user's mouth while the user wears the mask. According to an exemplary embodiment, the valve assembly is shown including a first valve assembly portion 221*a* and a second valve assembly portion 221*b*. The valve assembly portions 221*a*, 221*b* are connectable to the mask base 211. In the embodiment illustrated, two valve assembly portions 221*a*, 221*b* are provided and are disposed on opposite sides of the mask material or base 211. The outer valve assembly base or portion 221*a* is shown with a straw portion 227 having an outer segment 227*a* and an inner segment 227*b*. An adhesive layer 231 is provided on the inner face 222*a* of the base 221*a*. The adhesive sealant layer 231 may also include a layer of a release paper 232 that may be peeled off of the adhesive layer 231 to expose the adhesive surface 231. According to some embodiments, a double faced adhesive sealant may be used to attach the outer base 221*a* to the outer face 211*a* of the mask material or base 211. One adhesive sealant face may attach to the inner face 222*a* of the first valve assembly portion 221*a*, while the second adhesive sealant face may attach to the mask outer face 211*a*. The valve assembly 210 is shown including a second valve assembly portion or base 221*b* which has an inner face 222*b* that attaches to the mask material inner face 211*b*. A layer of adhesive sealant 233 is shown provided on the inner face 222*b* of the second portion 221*b*. Release paper 234 may be provided on the surface of the adhesive sealant layer 233. According to some embodiments, the adhesive sealant layer may include release paper provided on both sides thereof, with one side of the adhesive sealant layer attaching to the mask inner surface 211*b* and the other side of the adhesive sealant layer attaching to the second portion inner face 222*b*. A second straw portion 228 is shown including an inner section or mouthpiece 228*a* and a forward section 228*b* which in the embodiment illustrated projects beyond the second section inner surface 222*b*. The forward section 228*b* is shown having an angled edge 230 which is provided to cut through the mask material 211. The inner straw section 227*b* of the first straw portion 227 connects with the forward straw portion 228*b* of the second straw portion 228. According to preferred embodiments the straw 227 has a corrugated section 227*c* to facilitate movement and bending.

According to some embodiments, the second straw portion 228 may include a connector such as a bayonet, luer lock or luer slip fitting provided on the second straw portion and a matingly associated connector (e.g., such as a respective luer lock or luer slip fitting) is provided on the first straw portion 227. The fit may be press fit, or rotational locking, or slip fit. According to some embodiments the fittings on the respective first straw portion 227 and second or inner straw portion 228 may be securely joined by means of a tabbed hub on a female fitting (provided on one of the straw portions 227, 228), which screws into threads in a sleeve on the male fitting (provided on the other of the straw portions 227, 228). According to some embodiments, the fitting may comprise a one-piece type luer lock where the locking of the components together (such as the straw portions 227, 228) is achieved by relative rotation of connector (or straw containing the connector), while according to some other embodiments, a free rotating collar with threads is assembled to the luer of one of the straw portions, and the locking together of the straw portions 227, 228 is achieved by rotating the collar. According to some other embodiments, a slip type connection may be used provided by a slip tip fitting that is pressed together and held by friction (without the need for threads).

A check valve 235 is shown disposed within the passageway 240 of the conduit, and in the embodiment illustrated, the check valve 235 is disposed within the passageway of 240 of the second straw portion 228. The check valve 235 preferably is provided in the straw portion that is on the inside of the mask, which according to the embodiment illustrated, is the mouthpiece portion 228 or inner straw portion. According to some alternate embodiments, the check valve may be provided in the outer or first straw portion 227. The check valve 235 may comprise a suitable check valve for handling the liquid flow and preventing the exhalation or flow from the inside of the mask. According to an exemplary depiction, the check valve is shown comprising a valve seat 236 and a valve disc 237. The valve disc 237 engages with the valve seat 236 to seal the passageway 240. Normal exhalation by a user wearing the mask will not be sufficient to unseat the valve disc 237 off of the seat 236. However, if a user draws in on the mouthpiece 228*a*, the valve disc 237 will be lifted off of the seat 236 and allow flow through the passageway 240. The valve 235 provides resistance against normal breathing functions of a user wearing a mask fitted with the valve assembly 220. The mask material 211 provides for uptakes of breaths by a user wearing the mask to draw air through the mask material 211 while the valve disc 237 remains seated and the valve 235 closed. Similarly, normal exhalation will pass through the mask material 211 and the valve 235 will remain closed (sealed). According to preferred embodiments, the check valves, such as the valves 135 and 235, are sufficiently robust to prevent exhaled air to exit the mask through the straw passageway.

According to some embodiments, the valve assembly 220 may be connected to secure the mask material 211 between the two valve assembly portions 221*a*, 221*b*, and provide a tight sandwich of the portions 221*a*, 221*b*, to compress the mask material in a sealing engagement between the connection of the first and second valve assembly portions 221*a*, 221*b*.

As is depicted in FIG. 3, the valve assembly 210 may be installed on a mask by placing the adhesive sealant layers 231, 233 on the respective valve portion face 222*a*, 222*b*, bringing together the straw portions 227*b* and 228*b* and securing the exposed adhesive sealant faces 231 and 233 of the respective portions 221*a*, 221*b* onto the respective side of the mask material 211*a*, 211*b*. Pressure may be applied (by a person or assembly device) to press together the first valve assembly portion 221*a* and second valve assembly portion 221*b* to connect the assembly together. The sealant layers 231, 233 seal the opening 211*c* in the mask material 211 to seal around the straw or straw portion disposed at the opening 211*c*. When assembled, the mask with the drinking valve installed thereon may be used by an individual to drink beverages without removing the mask. The device 210 comprising the valve assembly 220 may be provided separately from a mask, or may be supplied with a mask, and according to some embodiments may be provided already installed on a mask.

Figure 4:
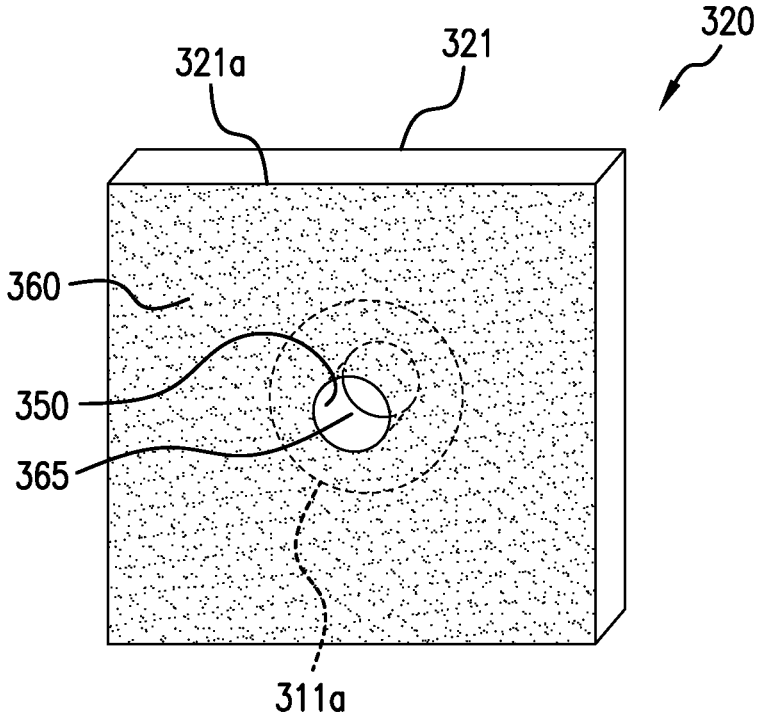
FIG. 4 is a perspective view of a component of a valve assembly, showing the valve assembly portion or plate separate from the mask and other components, and in an enlarged representation.

Referring to FIG. 4, the valve assembly 120 of FIGS. 1 and 2 is illustrated with an attachment mechanism for attaching the valve assembly 120 to the mask base or material 111. An aperture 111*a* is provided in the mask base 111 in a location proximate to where a user's mouth will align when the user wears the mask 110. A valve assembly portion 320, represented as an inner or outer valve portion shown comprising a base or plate 321 is depicted. The plate 321 may be similar to the bases 121*a*, 121*b*, 221*a*, 221*b* shown and described herein. The mask base aperture 311*a* is shown to represent the mask material of a mask and a location of the aperture 311*a*. An adhesive sealant layer 360 is provided and is shown adhered to the face 321*a* of the plate 321. The face 321*a* preferably is a side of the plate 321 that is to be mounted to a surface of the material base of a mask. The adhesive sealant layer 360 may comprise a suitable adhesive sealant and according to some preferred embodiments comprises a double faced adhesive. The adhesive sealant layer 360 is shown having an aperture 365 provided therein. The aperture 365 is provided in a location of the adhesive layer 360 which aligns with the aperture 311*a* of the mask base when the valve assembly plate 321 is installed. However, as shown in FIG. 4, the adhesive sealant layer aperture 365 is smaller in diameter than the mask base aperture 311*a*, and therefore a portion of the adhesive layer 360 seals over the mask base aperture 311*a*. The adhesive sealant material layer 360 is designed to engage the straw, such as the straw 125 (or straw section where the straw is supplied in separate parts), and form a seal around the straw 125. The adhesive sealant layer 360 includes an aperture 365, which according to preferred embodiments, is smaller than the straw diameter, and is flexibly provided to engage the straw exterior and form a seal around the straw, such as the straw 125. The adhesive sealing layer 360 engages the straw to form a barrier to prevent passage of air and liquids through the mask at the sealing location, and at the base aperture 311*a* to prevent passage of air and liquids therethrough. The valve assembly base plate 321 is shown having an aperture therein 350. The aperture 350 preferably is larger than the aperture 365 of the adhesive sealant layer 360. The adhesive sealant layer 360 provides a seal to seal off the aperture 350.

According to some embodiments, a single valve assembly plate, such as the plate 321 shown in FIG. 4 may be used. According to some embodiments, an additional adhesive sealing member, such as adhesive sealant layer having a face with an adhesive sealant, may be applied over the exterior of the mask over the mask opening (such as 311*a*), and may seal against the straw. The sealant layer 360 provides a seal against passage through the mask aperture 311*a* (FIG. 4), and the additional sealant layer on the mask exterior may also seal over the aperture from the exterior side of the mask.

According to preferred embodiments, a second valve assembly portion, which may comprise a second plate (similar to the plate 321), may be installed over the front of the mask, opposing the face of the plate 321 on the interior side of the mask (like the valve assembly portions shown in FIGS. 2 and 3). An adhesive sealant layer, similar to the layer 360 is provided on the mask facing face of the second valve assembly portion. The adhesive layer 360 of the first valve assembly plate 321 makes a positive adhesive seal with the adhesive layer of the second valve assembly plate so that there is an adhesive seal between the inner plate 321 and outer plate sealing around the straw or mouthpiece penetration. According to exemplary embodiments, the apertures are sized to permit the straw 125 (see e.g., FIGS. 1 and 2) to be sealed against the adhesive sealant layer 360 (and additional layer on the exterior valve portion). For example, the adhesive sealant layers on the respective valve assembly portions or plate faces form a seal where they meet, which is in the area around the straw 125 and in the location of the mask base aperture 311*a*.

The valve assembly plate aperture 350 is sized to accommodate the straw diameter therein. The mask base aperture 311*a* is shown larger than the aperture 365 of the adhesive sealant layer 360. According to some embodiments, the diameter of the mask aperture 311*a* may be about ⅝ inch, while the adhesive sealant aperture 365 may be about ⅜ inch. The base plate aperture 350 preferably is suitable to permit the adhesive sealant layer 365 to form a seal around the straw. According to some embodiments, the base plate aperture 350 may be similar in size to the mask base aperture 311*a* to permit the adhesive layers, such as the layer 365 and an opposing layer on another base plate to attach and form a seal to seal the mask aperture 311*a* and straw exterior surface. According to some embodiments, the base plate aperture 350 may be similar in size to the adhesive sealant layer aperture 365 to permit the adhesive layers, such as the layer 365 and an opposing layer on another base plate to attach and form a seal to seal the mask aperture 311*a* and straw exterior surface.

The straw 125 may extend through an aperture in the second valve assembly portion, or where the straw 125 is provided in separate parts (such as separate parts shown in FIG. 3), one of the straw parts may pass through the aperture in the second valve assembly portion. According to some embodiments, where the straw, such as the straw 125, is integral with one or more valve assembly component portions, the straw may be connected to the plate 321 and be integral therewith. The adhesive sealing layer 360 may be applied in a similar manner to seal to the face of the valve plate, and to seal around the straw.

According to some embodiments, the straw 125 is configured as an attachment and may be attached to the valve assembly component base, such as the first or second valve assembly component 221*a*, 221*b*. This may be accomplished using an adhesive sealant, and preferably an adhesive sealant layer, such as those shown and described herein, or alternatively may be welded or affixed using an alternate means.

The mask for drinking a beverage 110 is useful in many social settings where beverages are consumed or are the most commonly consumed food item, and where proximity to others is a concern. The mask has utility for example, in restaurant bars, lounges, waiting areas, conference functions, and other social functions where individuals gather together to enjoy a beverage. The mask 110 may be provided in a variety of colors and may be customized to bear logos, business names, and/or to normalize the mask as an article for use in everyday life and activities. A common beverage drink straw may be supplied by the beverage supplier (e.g., restaurant or bar), which preferably is a disposable plastic or paper straw. The front portion 127 of the straw 125 (or other front straw portion, e.g., 227) may be attachable or connectable to a common beverage drink straw or to a user's container, such as, for example, a water bottle having an integrated or associated straw. The adapter end, such as the end 127 or 227, may be configured to accommodate the water bottle type straws, or may include a fitting such as a tight rubber sleeve or other connector.

The valve assembly components may be made from any suitable non-reactive food-grade materials, including, but not limited to, plastics, silicone, urethanes, elastomers, and other substances and combinations thereof.

According to some embodiments, the masks shown and described herein, as well as the valve assembly products, and masks fitted with the valve assembly, may be constructed to meet requirements of governmental agencies and health bodies and organizations, including being produced in conformity with regulations that prescribe qualities and parameters for the types of mask (e.g., surgical, N95, respirator, and the like). Although some natural and synthetic materials have been referred to as examples for the mask base or body material, the mask may be constructed from any suitable materials, including materials used to form masks and provide the desired level of filtration through the mask material. In addition, although exemplary methods for producing the mask base material have been described, other suitable methods for producing the mask material may be used. According to some embodiments, the mask base may be commercially prepared or obtained commercially. In addition, according to some embodiments where a valve assembly is provided with a unitary integral valve assembly base and straw, the straw may comprise one or more portions, where at least one portion is integral with the valve assembly base. The components, such as, for example, the straw elements as well as the valve assembly base and/or adhesive sealant layers are depicted to illustrate the embodiments and may be made thinner than they are shown. The valve assembly base and/or adhesive sealant layer portions may be provided having smaller thicknesses and also may have a smaller footprint on the surfaces of the mask material. The valve assembly base and/or adhesive layer may be flexibly configured as a flexible member, and may be folded or bent when the mask is maneuvered. The straws, when provided in a plurality of sections, preferably include a suitable connection that seals, connects and preferably locks the straw portions together. For example, the layers 121*a*, 121*b* may comprise an adhesive sealant layer, or alternatively, may be constructed from a layer that may be flexible or rigid, and may be a thin layer, and may be constructed from a suitable material such as plastic, silicone or other material, and may be affixed to the mask base with an adhesive sealant to seal the straw to the mask opening. Features disclosed in one embodiment may be implemented in other embodiments. The masks herein with the valve assembly, may be provided to the user in a sterile form, being sterilized and provided in a sterile package, if desired. Alternatively, the masks may be provided in a non-sterile form, where a number of them may be supplied together in a bag, box or other container.

What is claimed is:

1. A single-use protective mask comprising:

a) at least one layer of material forming a mask base, the mask base being configured for placement over a wearer's mouth and nose;

b) means for removably securing the mask to the wearer in a position over the wearer's mouth and nose;

c) a straw having a passageway therethrough;

d) wherein the mask has an interior side and an exterior side;

e) said straw having a mouthpiece end on the interior side of the mask and an attachment end on the exterior side of the mask;

f) wherein said straw passes through an opening in said mask base; and g) a check valve situated in the passageway to regulate passage of fluid through the straw;

h) wherein an adhesive sealant seals the straw to the opening in the mask material; and i) wherein said adhesive sealant is arranged to completely surround the entire surface of the external circumference of the straw at the opening where the straw passes through the mask, thus effectively providing a permanent seal against the passage of airborne pathogens from the exterior side of the mask to the interior of the mask.

2. The protective mask of claim 1, wherein said check valve is configured to block passage of air and liquid from passing through the passageway, and wherein said check valve is configured to allow for one way passage through the passageway and into the mask when the check valve is overcome by a first force sufficient to open the check valve, and wherein said force sufficient to actuate said check valve is greater than the force of a user inhaling to take a breath.

3. The protective mask of claim 1, wherein said straw attachment end is configured to connect with a beverage straw and make a sealing connection therewith.

4. The protective mask of claim 3, wherein said straw attachment end is configured to connect with beverage straws having different size diameters.

5. The protective mask of claim 4, wherein said straw attachment end is tapered.

6. The protective mask of claim 5, wherein said straw attachment end has a stepped taper.

7. The protective mask of claim 1, including a valve assembly comprising a base, wherein said straw passes through said base, said base being attached to at least one side of the mask.

8. The protective mask of claim 7, wherein said valve assembly base includes a first part on the exterior side of said mask base and a second part on the interior side of said mask base, wherein said straw passes through said first part and said second part, and wherein said mask base is disposed between said first part and said second part.

9. The protective mask of claim 8, wherein said first part and said second part seal together said straw and said mask base opening.

10. The protective mask of claim 9, wherein said valve assembly base first part is configured to connect with said valve assembly base second part to capture a portion of said mask base therebetween, and wherein said first part and said second part are configured to connect to seal the straw and the mask base opening.

11. A protective device for a protective mask, comprising:

a) a valve assembly comprising:

i) a straw having a passageway therethrough; and ii) a check valve provided in the passageway;

b) wherein said valve assembly comprises mounting means for mounting the valve assembly on a protective mask to provide a passageway via said straw from said exterior of said mask to said interior of said mask, said passageway being sealed off by said check valve, and wherein said check valve is situated to allow flow through said passageway upon receiving a draw from said straw;

c) wherein said mask comprises at least one layer of material, wherein said mounting means for mounting the valve assembly on the protective mask comprises at least one first part positionable on the exterior side of said mask;

d) including a second part positionable on the interior side of said mask, wherein said first part and said second part are configured to connect together, and wherein said mask layer is disposed between said first part and said second part when connected together, wherein said straw includes a mouthpiece on the interior side of said mask, and wherein said straw includes a connecting end on said exterior side of said mask; and e) wherein at least one of said valve assembly first part or said valve assembly second part includes a puncture element configured to puncture the mask layer of material to create an opening therethrough, and wherein said valve assembly seals off said opening.

12. The protective device of claim 11, wherein said connection comprises adhesive.

13. The protective device of claim 12, wherein said first part of said valve assembly includes an inner face that is provided to face said exterior side of said mask, and wherein an adhesive layer is provided on said first part inner face; and wherein said second part of said valve assembly includes an inner face that is provided to face said interior side of said mask, and wherein an adhesive layer is provided on said second part inner face.

14. The protective device of claim 13, including release paper provided on each adhesive layer.

15. The protective device of claim 11, wherein said first part and said second part connect together with a press fit connection that secures the mask layer between the first part and second part.

16. The protective device of claim 15, wherein said press fit connection comprises one or more barbs and one or more sockets for receiving said one or more barbs.

17. The protective device of claim 11, wherein said first part and said second part connect together and wherein said straw is provided in two sections, including a first section that includes the mouthpiece, and a second section that include the connecting end, wherein said first straw section and said second straw section connect with each other to form a sealing connection, wherein said sealing connection comprises a luer lock or luer slip connection.

18. The protective device of claim 17, wherein at least one of said first straw section and said second straw section has an angled end.

19. A method for converting a protective mask to allow drinking a beverage while a user wears the mask, comprising:

a) providing a single-use mask; and b) installing a valve assembly on the mask to provide a passageway from the interior of the mask to the exterior of the mask, the valve assembly having a mouthpiece and an attachment end situated on opposite ends of a conduit defining the passageway therethrough, wherein said conduit includes a check valve that regulates liquid passage through said passageway to prevent exhalation through said passageway and to prevent liquid flow through said passageway from the interior of the mask to the exterior of the mask but allows liquid to be drawn in through the passageway from the exterior of the mask to the interior of the mask, wherein said conduit passes through an aperture in said mask, and wherein installing said valve assembly includes permanently sealing said aperture with a sealant around said conduit; wherein the sealant diameter is sized to assure complete sealing of the conduit to the mask;

c) wherein installing the valve assembly includes positioning the valve assembly to situate the mouthpiece on the interior side of the mask and to situate the attachment end on the exterior side of the mask.

20. The method of claim 19, wherein the valve assembly includes a plurality of parts, and the method includes securing together the one or more sections of the valve assembly to secure the valve assembly to the mask.

21. The method of claim 20, wherein the valve assembly includes a first part and a second part, wherein said first part engages the exterior surface of the mask, and wherein the second part engages the interior surface of the mask, and wherein said first part is connectable with said second part to provide a sealing connection of the valve assembly to the mask to seal the valve assembly to the mask material.

22. The method of claim 21, wherein installation of the valve assembly on the mask provides a one way flow direction for liquids in a first direction, and wherein said check valve seals said passageway against flows of air and liquid in a direction opposite to the first direction, wherein liquids are taken up when a user draws through the mouthpiece, and wherein the mask material provides for air passage via inhalation and exhalation of the user wearing the mask.

23. The method of claim 21, wherein said sealant comprises an adhesive sealant layer provided on each of said first part and said second part, and wherein release paper is provided on each adhesive sealant layer, and wherein said first part is connectable with said second part to provide a sealing connection of the valve assembly to the mask to seal the valve assembly to the mask material by removing the release paper to expose each said adhesive sealant layer and adhering said first part to the mask exterior and adhering said second part to the mask interior.

24. A single-use protective mask comprising:

a) at least one layer of material forming the mask base, the mask base being configured for placement over a wearer's mouth and nose;

b) means for removably securing the mask to the wearer in a position over the wearer's mouth and nose;

c) a straw having a passageway therethrough;

d) wherein the mask has an interior side and an exterior side;

e) said straw having a mouthpiece end on the interior side of the mask and an attachment end on the exterior side of the mask;

f) wherein said straw passes through said mask base;

g) a check valve situated in the passageway to regulate passage of fluid through the straw;

h) wherein said check valve is configured to block passage of air and liquid from passing through the passageway, and wherein said check valve is configured to allow for one way passage through the passageway and into the mask when the check valve is overcome by a first force sufficient to open the check valve, and wherein said force sufficient to actuate said check valve is greater than the force of a user inhaling to take a breath;

i) wherein said straw attachment end is configured to connect with a beverage straw and make a sealing connection therewith; and wherein said straw attachment end is configured to make a sealing connection with beverage straws having different size diameters;

j) wherein said mask base includes an aperture therein through which said straw passes; and k) an adhesive sealant sealing the mask base aperture and the straw;

l) wherein said adhesive sealant is disposed about the circumference of the straw and effectively provides a permanent seal against the passage of pathogens from passing between the mask opening and the straw.

25. The protective mask of claim 24, including a pair of valve assembly plates mounted on each side of said mask base material; and wherein said straw passes through said plates.

26. The protective mask of claim 25, wherein each said valve assembly plate has a face and wherein said face is secured to said mask material, on a respective side of the mask, with an adhesive sealant layer.

27. The protective mask of claim 26, wherein said adhesive sealant layer comprises the adhesive sealant that seals the mask base aperture and the straw.

28. A single-use protective mask comprising:

a) at least one layer of material forming a mask base, the mask base being configured for placement over a wearer's mouth and nose; wherein the mask has an interior side and an exterior side and an aperture provided in said mask base;

b) a straw having a passageway therethrough, said straw passing through said mask base aperture;

c) a check valve situated in the passageway to regulate passage of fluid through the straw; and d) a seal sealing the straw and the mask base aperture providing a seal between the mask material and the straw;

e) wherein said check valve is configured to block passage of air and liquid from passing through the passageway, and wherein said check valve is configured to allow for one way passage through the passageway and into the mask when the check valve is overcome by a first force sufficient to open the check valve, and wherein said force sufficient to actuate said check valve is greater than the force of a user inhaling to take a breath;

f) said seal comprising an adhesive sealant, wherein said adhesive sealant effectively provides a permanent seal against the passage of pathogens from passing between the mask opening and the straw.

29. The protective mask of claim 28, wherein said seal comprises an adhesive sealant layer.

30. The protective mask of claim 29, including a valve assembly base plate.

31. The protective mask of claim 30, wherein said straw is integrally provided as part of said valve assembly base plate.

32. The protective mask of claim 31, wherein said valve assembly base plate comprises a first plate, and including a second valve assembly base plate, wherein said first valve assembly base plate is provided on the interior side of the mask material at the aperture opening, and wherein said second plate is provided on the exterior side of the mask, and wherein said plates are attached to the mask.

33. The protective mask of claim 28, wherein said seal comprises a valve assembly base and wherein said valve assembly base comprises an adhesive sealant layer.

* * * * *